US006334597B1

(12) United States Patent
Ming-Hsiao

(10) Patent No.: US 6,334,597 B1
(45) Date of Patent: Jan. 1, 2002

(54) HANGER HOLDER FOR USE IN BATHROOM

(76) Inventor: Lai Ming-Hsiao, 8-26, Lane 2, Kung Chi Village, Ta Tsuen, Hsiang, Chang-Hua Hsien (TW)

( * ) Notice: Subject to any disclaimer, the term of this patent is extended or adjusted under 35 U.S.C. 154(b) by 0 days.

(21) Appl. No.: 09/591,428

(22) Filed: Jun. 9, 2000

(51) Int. Cl.[7] ..... F16B 45/00
(52) U.S. Cl. ..... 248/305
(58) Field of Search ..... 248/305, 309.1, 248/231.91, 231.9

(56) References Cited

U.S. PATENT DOCUMENTS 1,893,729 A * 1/1933 Call ..... 248/251
5,026,013 A * 6/1991 Robbins ..... 248/223.1
5,071,099 A * 12/1991 Kuo ..... 248/222.1
5,186,427 A * 2/1993 Semchuck ..... 248/251
5,664,751 A * 9/1997 Lan ..... 248/251
6,113,045 A * 9/2000 Kuo ..... 248/222.14
6,244,549 B1 * 6/2001 Ching ..... 248/222.14

* cited by examiner

*Primary Examiner*—Leslie A. Braun
*Assistant Examiner*—Kofi Schulterbrandt
(74) *Attorney, Agent, or Firm*—Harrison & Egbert

(57) ABSTRACT

A hanger holder is formed of a base, a locating seat, a connection seat, and a holding member. The base is fastened to a wall and is provided with a pillar by which the locating seat, the connection seat, and the holding member are joined together to form the hanger holder in conjunction with a fastening screw that is engaged with a retaining hole of the pillar via a through hole of the holding member.

2 Claims, 6 Drawing Sheets

HANGER HOLDER FOR USE IN BATHROOM

BACKGROUND OF THE INVENTION

1. Field of the Invention

The present invention relates generally to a holder, and more particularly to a holder for a hanger.

2. Description of Related Art

As shown in FIG. 1, a prior art hanger holder 10 is made integrally and is therefore rather monotonous in design. In addition, the prior art hanger 10 can not be electroplated in different colors. The aesthetic effect of the prior art hanger holder 10 is thus compromised.

As shown in FIG. 2, another prior art hanger holder comprises a base 101 and an arm 102 which is made separately. The base 101 and the arm 102 can be electroplated in different colors. The arm 102 is fastened to the base 101 by a screw 103. In light of the metal fatigue of the screw 103, the arm 102 is apt to loosen after a prolonged use of the hanger holder.

BRIEF SUMMARY OF THE INVENTION

The primary objective of the present invention is to provide a hanger holder which is free from the deficiencies of the prior art hanger holders described above.

In keeping with the principle of the present invention, the foregoing objective of the present invention is attained by a hanger holder comprising a base, a connection seat, and a holding member, which are made separately and electroplated in different colors.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
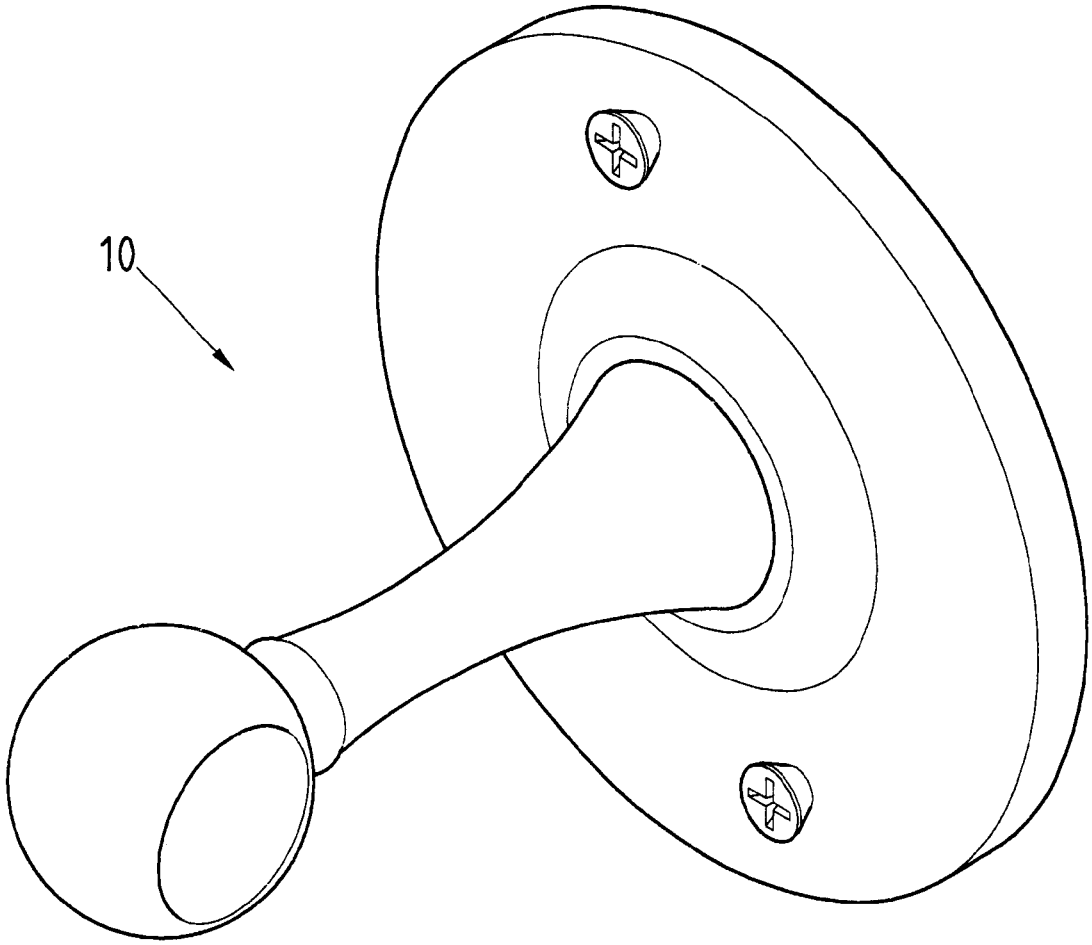
FIG.1 PRIOR ART
FIG. 1 shows a perspective view of a hanger holder of the prior art.
Figure 2:
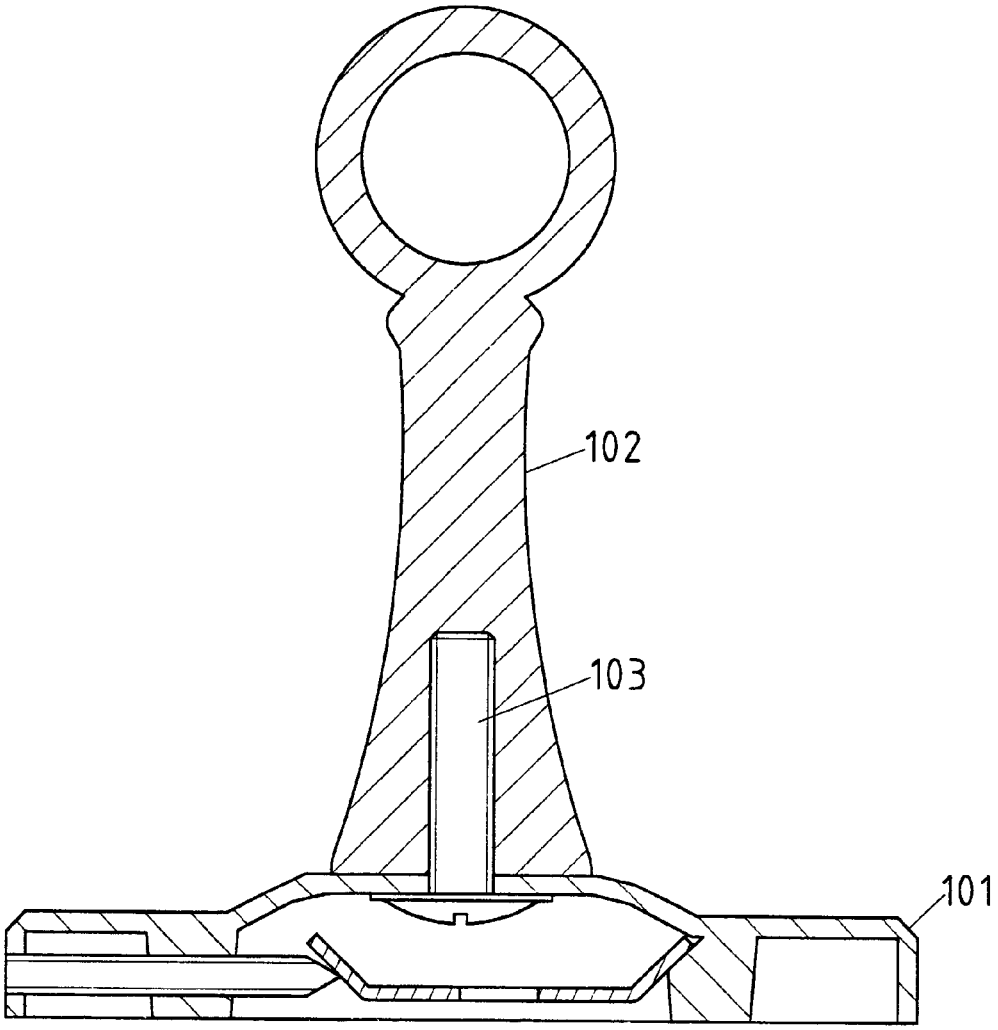
FIG.2 PRIOR ART
FIG. 2 shows a sectional view of another hanger holder of the prior art.
Figure 3:
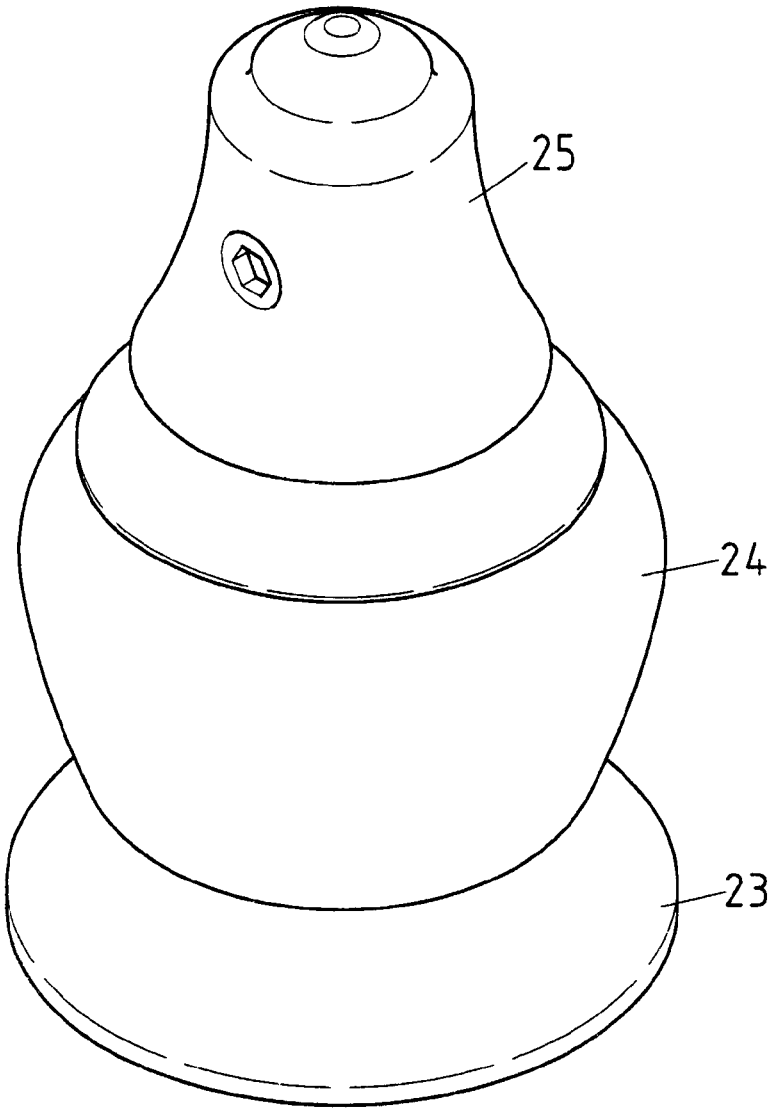
FIG. 3 shows a perspective view of a hanger holder of the preferred embodiment of the present invention.
Figure 4:
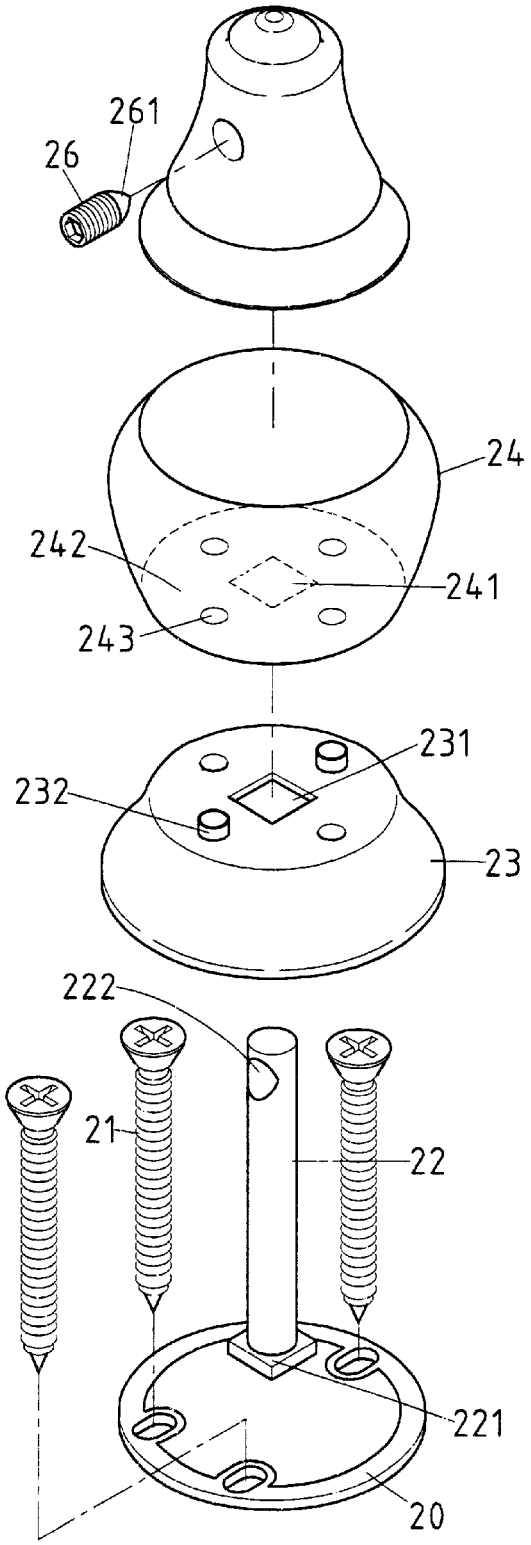
FIG. 4 shows an exploded view of the hanger holder of the preferred embodiment of the present invention.
Figure 5:
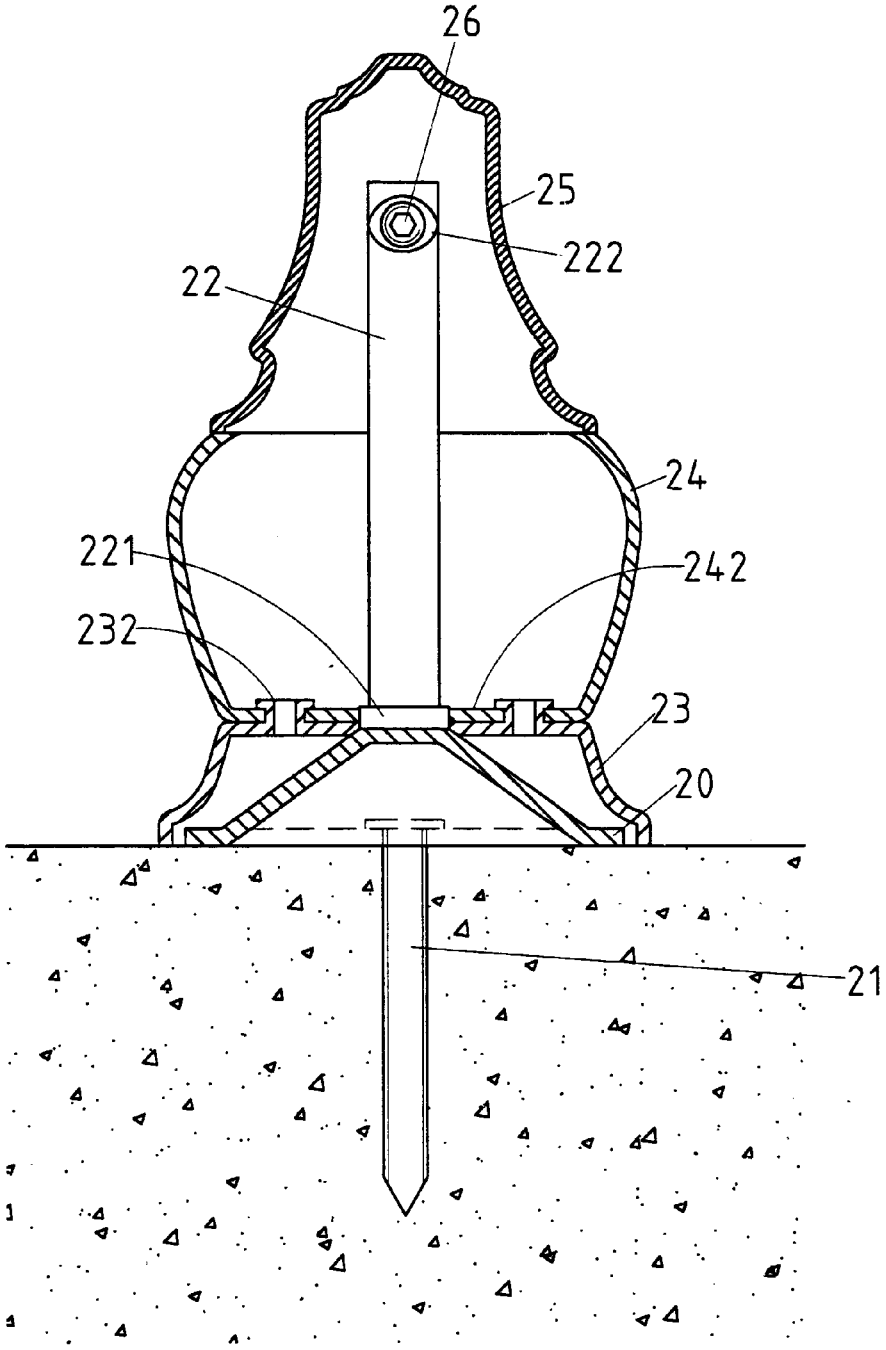
FIGS. 5 shows a sectional view of the hanger holder of the preferred embodiment of the present invention.
Figure 6:
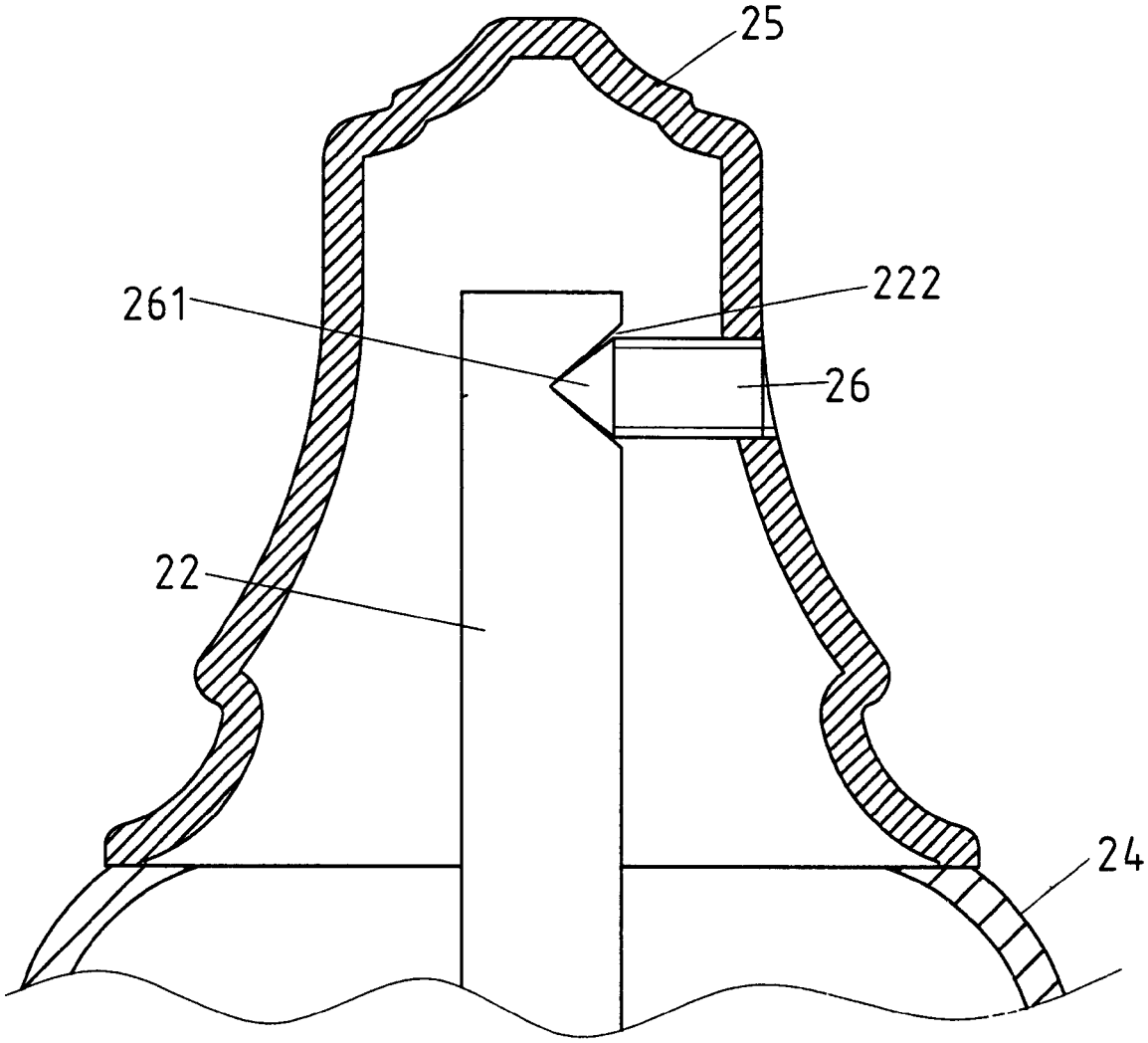
FIGS. 6 shows a partial sectional view of the hanger holder of the preferred embodiment of the present invention.

As shown in FIGS. 3–6, a hanger holder of the preferred embodiment of the present invention comprises a base 20, a locating seat 23, a connection seat 24, and a holding member 25.

The base 20 is fastened to a bathroom wall by a plurality of screws 21 and is provided in the outer surface with a pillar 22 fastened there to. The pillar 22 is provided at the fastening end with a polygonal protrusion 221, and at the free end with a retaining hole 222.

The locating seat 23 is provided with a polygonal through hole 231, and a plurality of retaining projections 232.

The connection seat 24 is provided in a bottom plate 242 with a polygonal hole 241 corresponding in location and size to the polygonal through hole 231 of the locating seat 23. The connection seat 24 is further provided in the bottom plate 242 with a plurality of retaining through holes 243 corresponding in location to the retaining projections 232.

The holding member 25 is of a hollow construction and is provided with a free end having an opening. The holding member 25 is provided in the wall with a through hole.

In combination, the locating seat 23 is joined with the base 20 such that the pillar 22 of the base 20 juts out of the polygonal through hole 231 of the locating seat 23. The connection scat 24 is joined with the locating seat 23 in such a manner that the pillar 22 of the base 20 juts out of the polygonal hole 241 of the base plate 242 of the connection seat 24, and that the retaining projections 232 of the locating seat 23 are received in the retaining through holes 243 of the bottom plate 242 of the connection seat 24. The holding member 25 is joined with the connection seat 24 such that the holding member 25 is fastened to the pillar 22 of the base 20 by a screw 26 having a tapered end 261. The screw 26 is engaged with the retaining hole 222 of the pillar 22 via the through hole of the wall of the holding member 25.

The locating seat 23, the connection seat 24 and the holding member 25 of the preferred embodiment of the present invention can be electroplated in different colors, so as to enhance the overall aesthetic effect of the hanger holder of the preferred embodiment of the present invention.

The embodiment of the present invention described above is to be regarded in all respects as being merely illustrative and not restrictive. Accordingly, the present invention may be embodied in other specific forms without deviating from the spirit thereof. For example, the retaining hole 222 of the pillar 22 of the base 20 may be of a V-shaped construction, thereby enabling the tapered end 261 of the screw 26 to be retained in the V-shaped retaining hole 222. The present invention is therefore to be limited only by the scope of the following appended claims.

What is claimed is:

1. A hanger holder comprising:

a base fastened to a wall by a plurality of screws and provided in an outer surface thereof with a pillar having a polygonal base and a retaining hole located at a free end thereof;

a locating seat provided with a polygonal through hole and a plurality of retaining projections, said locating seat being joined with said base such that said pillar of said base is put through said polygonal through hole of said locating seat;

a connection seat provided in a bottom with a polygonal hole and a plurality of retaining holes, said connection seat being located on said locating seat such that said pillar of said base is put through said polygonal hole of said connection seat, and that said retaining projections of said locating seat are received in said retaining holes of said connection seat; and a holding member of a hollow construction and having an opening, said holding member provided in the wall with a through hole, said holding member being joined with said connection seat and fastened to said pillar of said base by a fastening screw whereby said fastening screw is engaged with said retaining hole of said pillar via said through hole of said holding member.

2. The hanger holder as defined in claim 1, wherein said retaining hole of said pillar of said base is of a V-shaped construction; and wherein said fastening screw has a tapered end whereby said tapered end is received in said V-shaped retaining hole of said pillar of said base.

* * * * *